US009423771B2

(12) United States Patent
Bas et al.

(10) Patent No.: US 9,423,771 B2
(45) Date of Patent: Aug. 23, 2016

(54) METHOD FOR PLACING A WATCH CASE UNDER A PROTECTIVE ATMOSPHERE

(71) Applicants: Kewin Bas, Villers-le-Lac (FR); Cyrille Chatel, La Chenalotte (FR); Jean-Jacques Vuillemier, Corcelles (CH)

(72) Inventors: Kewin Bas, Villers-le-Lac (FR); Cyrille Chatel, La Chenalotte (FR); Jean-Jacques Vuillemier, Corcelles (CH)

(73) Assignee: CARTIER INTERNATIONAL AG, Steinhausen (CH)

( * ) Notice: Subject to any disclaimer, the term of this patent is extended or adjusted under 35 U.S.C. 154(b) by 211 days.

(21) Appl. No.: 14/362,172

(22) PCT Filed: Dec. 3, 2012

(86) PCT No.: PCT/IB2012/002570

§ 371 (c)(1),
(2) Date: Jun. 2, 2014

(87) PCT Pub. No.: WO2013/084042

PCT Pub. Date: Jun. 13, 2013

(65) Prior Publication Data

US 2015/0040400 A1 Feb. 12, 2015

(30) Foreign Application Priority Data

Dec. 9, 2011 (EP) ..... 11009678

(51) Int. Cl.
*G04B 37/02* (2006.01)
*G04D 7/00* (2006.01)

(52) U.S. Cl.
CPC ..... *G04B 37/02* (2013.01); *G04D 7/007* (2013.01); *Y10T 29/49584* (2015.01); *Y10T 29/53* (2015.01)

(58) Field of Classification Search
CPC ..... Y10T 29/49584; G04D 1/10; G04D 1/0071; G04D 1/0021; G04D 1/005; G04D 1/0078; G04D 1/0053
See application file for complete search history.

(56) References Cited

U.S. PATENT DOCUMENTS 3,030,763 A 4/1962 Klingenberg
3,145,459 A * 8/1964 Shiffman ..... G04D 1/10 279/110

(Continued)

FOREIGN PATENT DOCUMENTS

BE 661 940 10/1965
CH 312 740 2/1956

(Continued)

OTHER PUBLICATIONS

International Search Report dated Jan. 22, 2013, corresponding to PCT/IB2012/002570.

*Primary Examiner* — Jason L Vaughan
(74) *Attorney, Agent, or Firm* — Young & Thompson

(57) ABSTRACT

A method of placing under a protective atmosphere a watch case fitted with its movement, includes: installing the watch case in the housing of a support including a unit for holding the watch and a unit for guiding an actuator acting on a part of the case; introducing the support into a flexible pouch; installing the support in the open pouch in a device for imposing a protective atmosphere; reducing the pressure within such device; closing the pouch containing the support; extracting the support from the sealed pouch of the device for imposing a protective atmosphere; closing the watch case by acting on the actuator via the outside of the pouch in order that it displaces a part of the watch according to the guide unit in order to close the watch; opening the pouch and separation of the actuator from the part of the case on which it acts.

19 Claims, 6 Drawing Sheets

(56) References Cited

U.S. PATENT DOCUMENTS 3,179,236 A * 4/1965 Bower ..... B65G 37/00 198/465.1
3,209,624 A * 10/1965 Shiffman ..... G04D 1/10 81/128
3,234,641 A * 2/1966 Schneider ..... B23K 20/10 228/1.1
3,359,839 A * 12/1967 Miller ..... G04D 1/10 81/6
3,625,093 A * 12/1971 Freiburghaus ..... B04D 1/10 29/240
3,630,014 A * 12/1971 Jeannet ..... G04B 17/00 310/36
3,729,104 A * 4/1973 Takiguchi ..... G04D 1/0021 414/788.7
3,750,387 A 8/1973 Bandelier et al.
3,932,944 A * 1/1976 Chiba ..... F26B 5/04 34/104
3,978,710 A * 9/1976 Ratajski ..... G04D 7/007 73/49.3
6,920,692 B2 * 7/2005 Uchida ..... B23K 20/002 29/458
9,063,517 B1 * 6/2015 O'Neil ..... G04D 1/10

FOREIGN PATENT DOCUMENTS

| | | |
|---|---|---|
| CH | 390 154 | 12/1964 |
| DE | 80 24 237 | 4/1986 |
| FR | 1546744 | 11/1968 |
| FR | 2054540 | 4/1971 |
| GB | 1272183 | 4/1972 |

* cited by examiner

METHOD FOR PLACING A WATCH CASE UNDER A PROTECTIVE ATMOSPHERE

The present invention relates to a method for placing under a protective atmosphere, and in particular a method for placing under a vacuum, a watch case incorporating the watch movement. Within this application a "vacuum" or "protective atmosphere" is understood to mean a pressure which is generally lower than atmospheric pressure, with or without an to added gas, which is maintained within a case optimised to preserve this low pressure.

This results in a timepiece movement which is intended to function under a low-pressure atmosphere, i.e. cased-up in a sealed case in which the pressure has been lowered below atmospheric pressure and the composition of the atmosphere has possibly been modified to limit oxidation, wear and aging of certain elements of the movement.

For example, from documents FR1546744, FR2054540 and GB1272183 a watch is known which is under reduced pressure and of which the quality and reliability over time are improved, in particular because the risks of oxidation of the movement and of the oils are overcome and by virtue of the fact that aging of the lubricants and wear owing to oxidation and corrosion are reduced. Moreover, as indicated by FR2054540, by reducing the pressure prevailing within a watch case, the loss of energy owing to air friction tends towards zero and hence the quality factor of the oscillator of the timepiece movement increases considerably. U.S. Pat. No. 3,750,387 discloses several variations for placing a watch case under a vacuum, e.g. by pumping the air within the watch case through a valve provided in the watch case or by casing-up the movement in the watch case and screwing the bottom in a device for imposing a controlled atmosphere. The techniques described in these earlier documents still require either specific arrangements within the watch case such as a valve, or that highly complex operations be carried out, such as casing-up, screwing the case bottom and/or regulating the watch under a controlled atmosphere (in particular within a device for imposing a protective atmosphere such as a Henkelman device), which is costly and relatively difficult to effect.

The object of the present invention is to obviate the disadvantages mentioned above by proposing a method for placement under a protective atmosphere and in particular for reduction of the pressure within a watch case. This method does not require any particular arrangement within the watch case and can consequently be applied to all sealed watch cases. The method which is the object of the present invention is also aimed at dispensing with the need to carry out certain operations under a controlled atmosphere, thus reducing manufacturing costs.

One aspect of this object is achieved by a method comprising the following steps:

- installation of the watch case, which is not completely closed, in the housing of a support comprising means for holding the watch as well as means for guiding an actuator acting on a part of the watch;
- introduction of the support into a flexible pouch;
- installation of the support in the open pouch in a device for imposing a protective atmosphere;
- reduction of the pressure within the device for imposing a protective atmosphere;
- closure of the pouch containing the support;
- extraction of the support from the sealed pouch of the device for imposing a protective atmosphere;

- closure of the watch case by acting on an actuator via the outside of the pouch in order that it displaces a part of the watch according to the guide means;
- opening of the pouch and separation of the actuator from the part of the case on which it acts.

According to one embodiment of the method, the watch case is installed in the support with its winding stem in position but with the case bottom disconnected from the case, the case being closed by acting by means of a bottom push-piece in order to permit closure of the case.

According to another embodiment the case is installed closed in the support, except for the winding stem. The closure of the case being effected by acting on a stem push-piece in order to permit introduction of the winding stem into the watch case in order to close it. Other advantages of the invention issue from the steps described in the dependent claims and appearing in the detailed description which follows with reference to the schematic drawings attached by way of example and in which:

Figure 3:
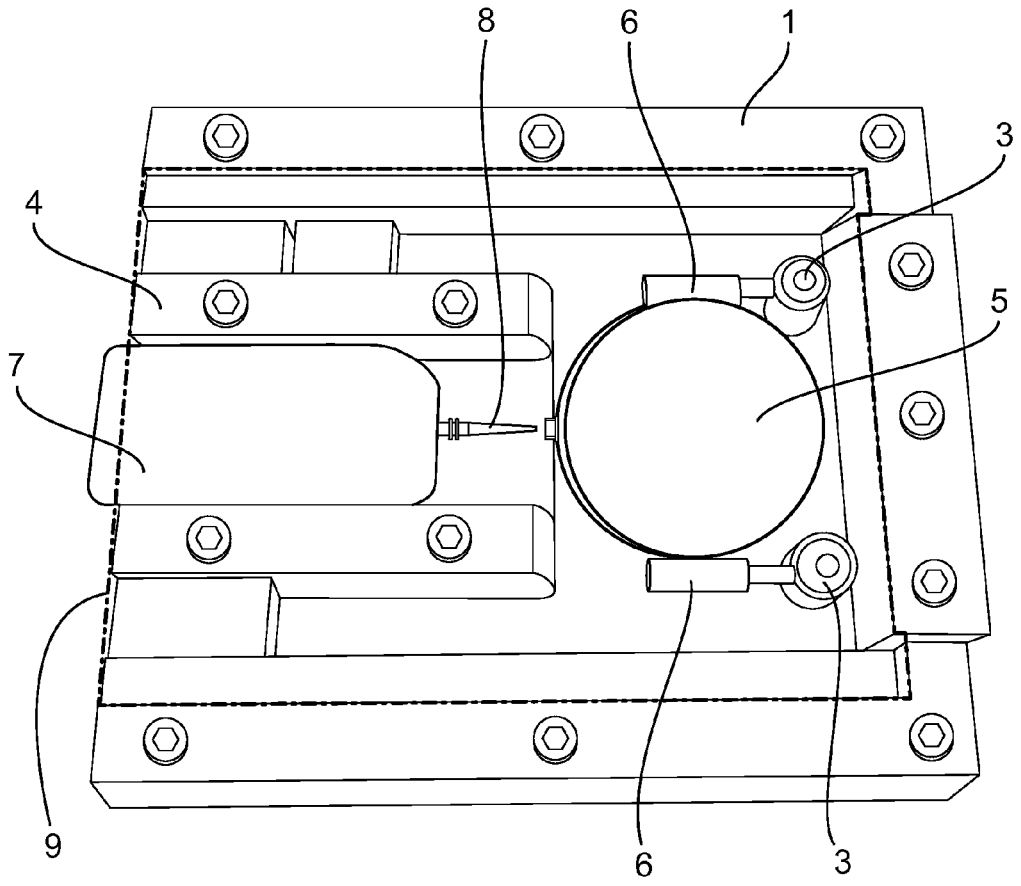

FIG. 3 schematically illustrates the support provided with its cover.

Figure 4:
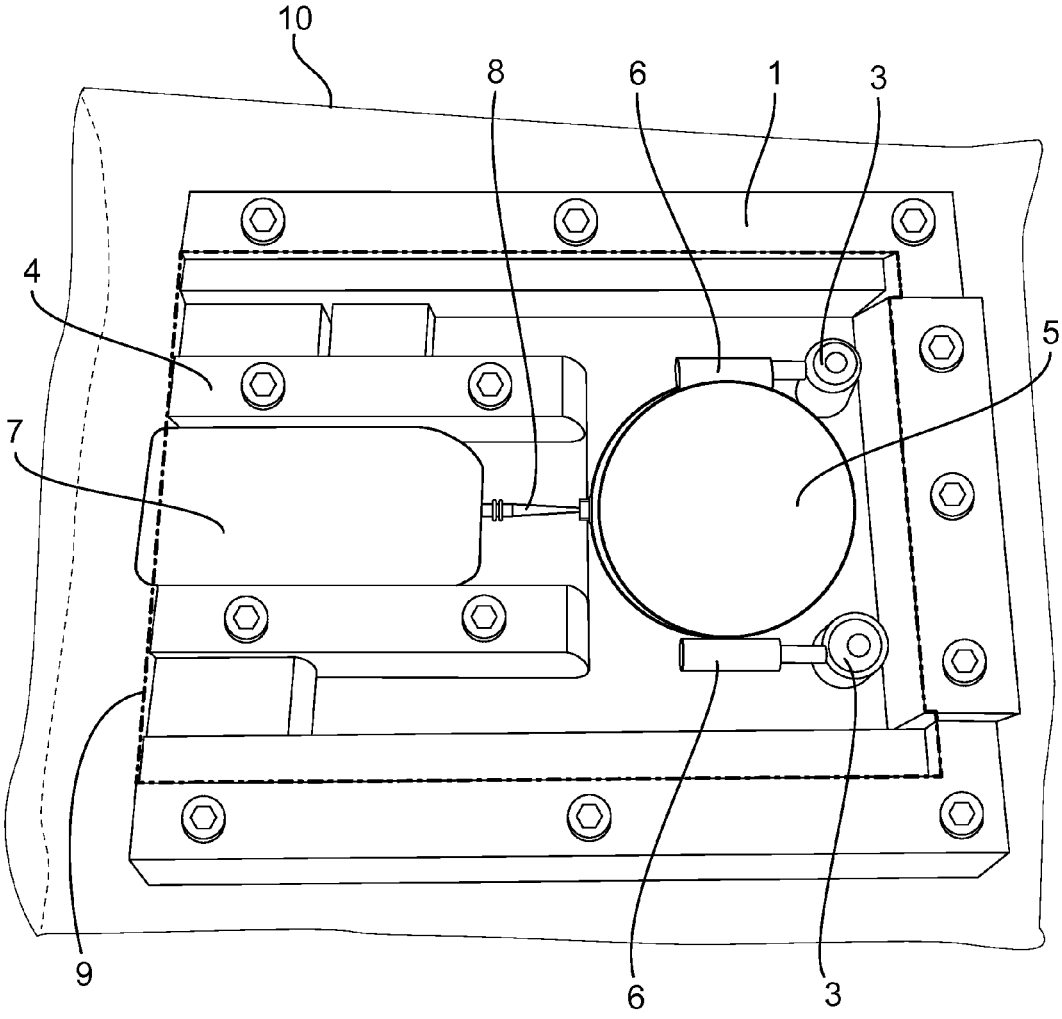

FIG. 4 illustrates the support in its pouch, before being introduced into a device for imposing a controlled atmosphere.

Figure 5:
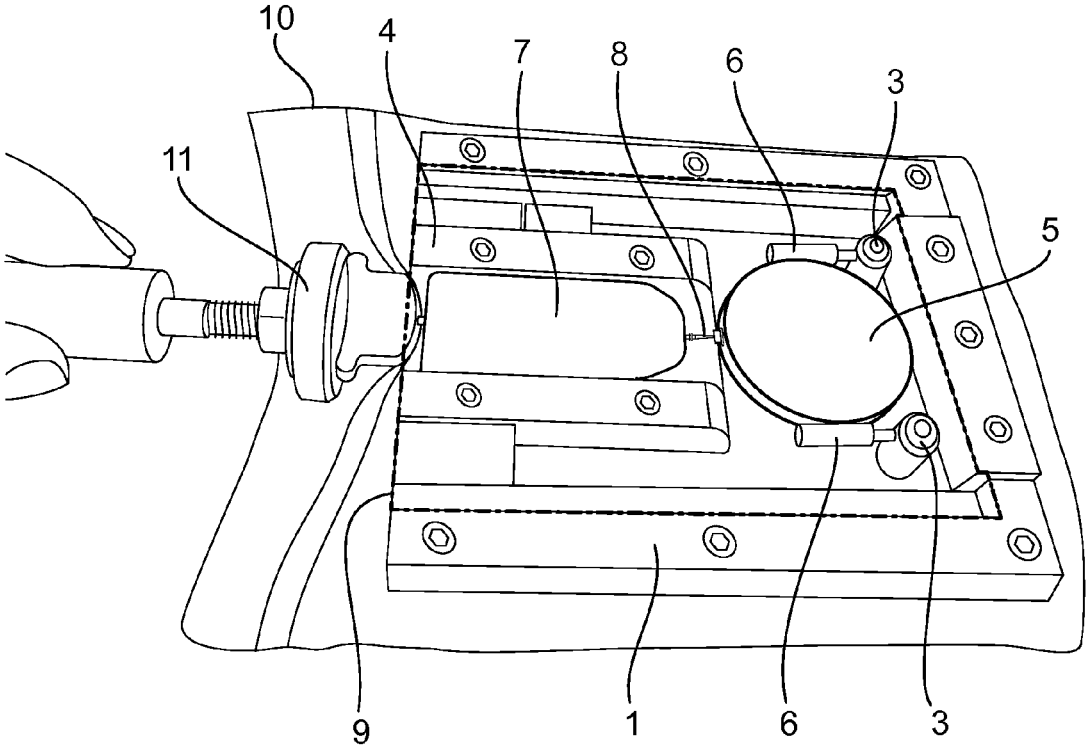

FIG. 5 illustrates the support in its flexible pouch under vacuum.

Figure 6:
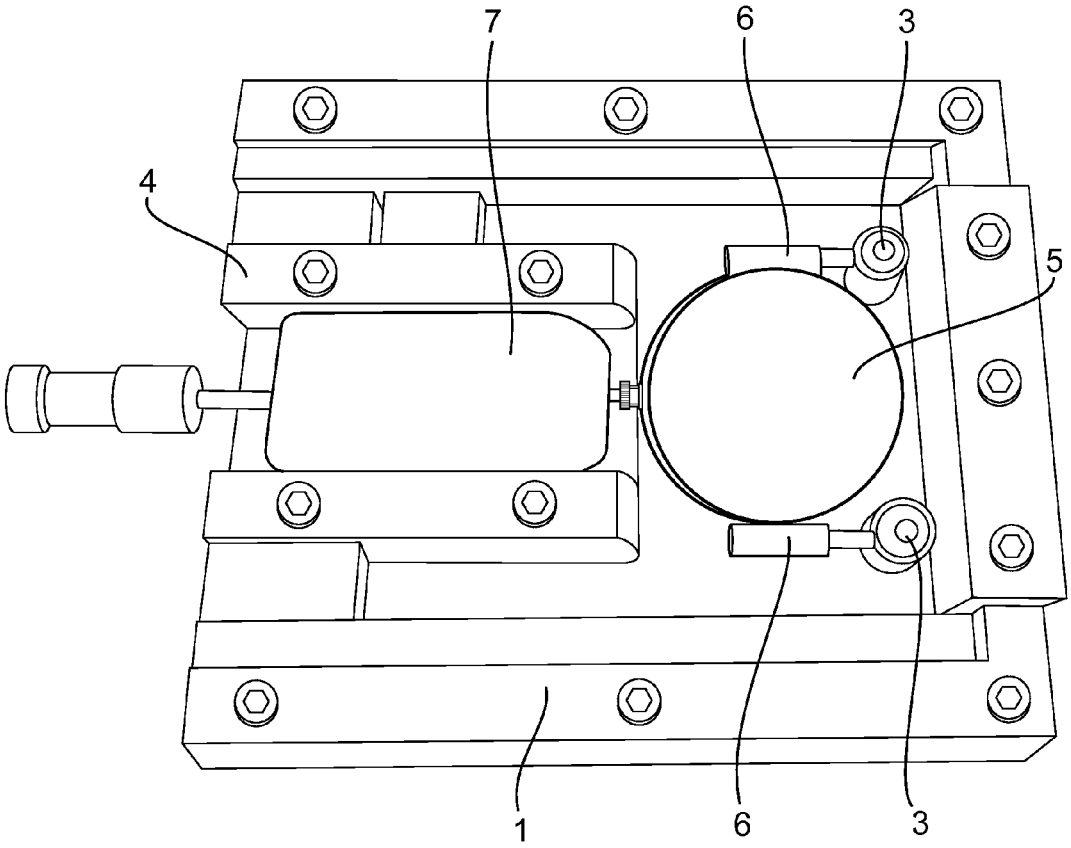

FIG. 6 illustrates the support with its flexible pouch removed after introduction of the winding stem.

Figure 1:
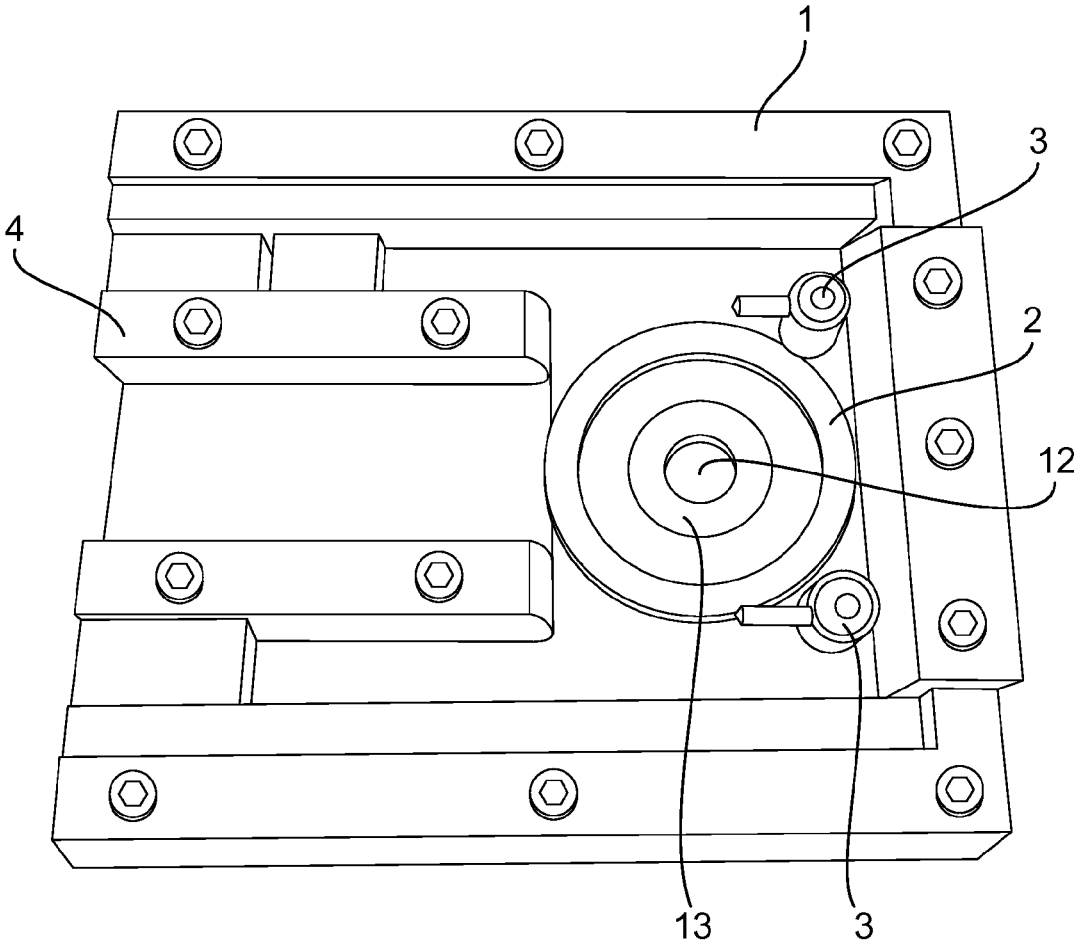
FIG. 1 illustrates a support intended to receive the watch case.
Figure 2:
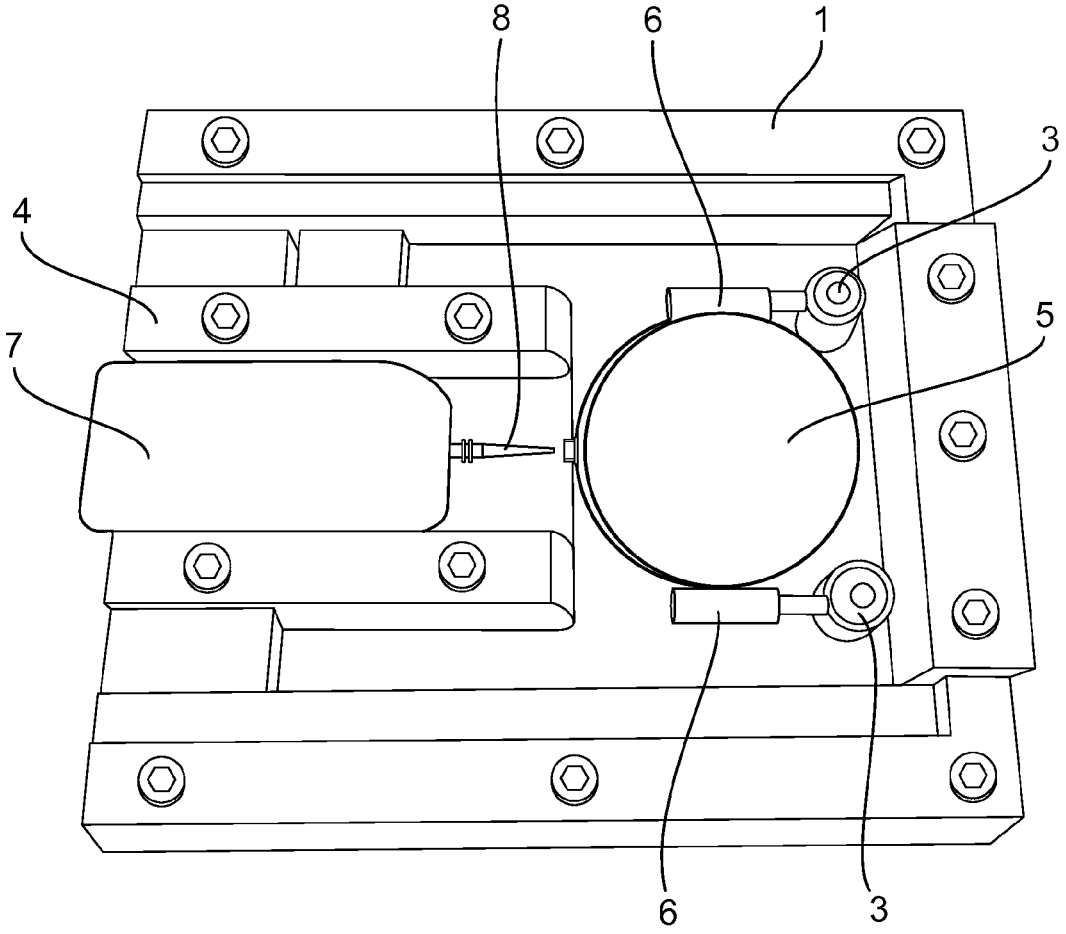
FIG. 2 illustrates the same support with the watch case installed.

FIG. 1 shows a support 1 intended to receive a watch case in a housing 2. The support 1 also has—on both sides of the housing 2—holding members 3 intended to precisely position and hold the watch case in the housing 2. The holding members 3 are shown in the form of rotating studs provided with a stem which cooperates with horns of the watch case. However, it is possible to provide variations of these holding members depending on the configuration of the watch case. The support 1 also has guide means 4 forming, in this embodiment, a housing intended to receive an actuator shown in the form of a push-piece 7 of the winding stem 8. According to this embodiment, FIG. 2 illustrates the support 1 in which is disposed a watch case 5 held in position by its horns 6 with the aid of the holding members 3. When the watch case 5 is placed in the support 1, the movement is already cased-up within the case and the bottom of the case is screwed. The watch is thus completely finished except for its winding stem 8 which is positioned in the stem push-piece 7 facing the stem hole, but without being engaged in the stem hole of the watch case.

In another embodiment, the support, its holding means and its guide means for closure of the case can be shaped differently. In this case, the watch case is introduced open into the support, i.e. with the bottom open. The bottom of the case rests on the support, the rest of the case being held by holding members. In this case, the bottom of the case can be displaced upwards by an actuator such as a bottom push-piece 12 guided and sliding in cylindrical guide means 13.

The next step of the method consists of placing a cover 9, preferably made of transparent material (such as Plexiglas) to improve visibility, on the support 1 so as to close it off on its upper face.

FIG. 3 illustrates the support 1 in which the watch case as well as the stem push-piece 7 are arranged in their respective positions, the cover 9 being placed on the support 1.

The support 1 is then introduced into a flexible pouch such as a sachet made of synthetic material 10 which is shown in FIG. 4. The complete support 1 enclosed in its open pouch is then disposed in the casing of a device for imposing a controlled atmosphere or imposing a vacuum, such as e.g. a Henkelman type machine. The cover 9 makes it possible to prevent the flexible pouch coming into contact with the watch case during the operation of placement under vacuum.

A vacuum is then produced in the casing of the device. Once the desired level of vacuum is achieved, e.g. a pressure between 1 and 3 mbar, the flexible pouch is advantageously sealed by thermo-fusion.

At this stage, the winding stem not yet being positioned in the watch case according to this example, the pressure within the watch is identical to that prevailing inside the pouch 10, i.e. 1 to 3 mbar according to the example given above.

Placement under a protective atmosphere is preferably effected progressively, the time during which pressure is reduced being of the order of 1 minute, until a pressure of the order of 1 to 3 mbar is reached. Once this pressure is reached, the support 1 is kept in its open pouch for a period of time between e.g. 2 and 5 minutes to permit all the air within the watch case to be evacuated.

Supplementary steps may advantageously be provided before closure of the pouch within the device for imposing a protective atmosphere.

These supplementary steps consist e.g. of a rise in pressure by injection of helium (or another gas) into the pouch until a pressure of the order of 100 mbar is reached, then progressive placement under vacuum until the desired value is achieved. The rise in pressure will preferably be effected over a period of time of the order of 1 minute. This pressure is then maintained for about 1 further minute to permit homogeneous diffusion of the gas in the capillaries of the movement.

By virtue thereof, the hygrometry within the watch case is reduced, thus avoiding corrosion of the components of the movement of the watch. Once the desired vacuum is achieved in the sealed flexible pouch, the support 1, still enclosed in its pouch, is withdrawn from the casing of the vacuum machine. According to one embodiment of the invention, the watch case being closed but the winding stem not having been introduced into the watch case, a tool 11 shown in FIG. 5 is used to act upon the stem push-piece 7 via the outside of the pouch 10. The push-piece 7 is guided by the guiding members 4 to position the winding stem 8 in the winding hole.

When the winding stem 8 is in place in the watch case, the latter is hermetically closed. During this step, the pressure within the watch is thus identical to that prevailing in the flexible pouch.

According to another embodiment of the invention, the watch case being open and the winding stem having been positioned before this step, a suitable tool is used to act upon the bottom push-piece 12 via the outside of the flexible pouch so as to push the bottom of the watch case against the case in order to close it. The guide means 13 permit guidance of the bottom push-piece 12 during this step. Once again, the pressure within the watch is thus identical to that prevailing in the flexible pouch, which, when the watch is at atmospheric pressure, serves to hermetically close the bottom even without screwing the bottom. Such screwing can thus be effected once the watch leaves the pouch in a final step of the method.

This final step consists of releasing the support from its pouch e.g. using a cutter or any other slicing tool. Upon opening the flexible pouch, the interior of the support is once again at atmospheric pressure, whereas the watch having been hermetically closed (by closure of the case within the sealed pouch), retains the pressure obtained during the step of placement under vacuum.

Finally, in the illustrated embodiment, a specific tool is used to separate the stem from the stem push-piece, the latter preferably having a through-hole. This method has a number of advantages because it does not require specific equipment such as a valve fitted to the watch case. It is also no longer necessary to effect complex operations such as casing-up, regulating or screwing the case bottom under a controlled atmosphere. It can also easily be automated on an industrial scale. In the example described above, the method was implemented using a flexible pouch. According to another aspect of the invention, it can also be envisaged that—although more expensive—a rigid pouch could be provided, fitted with a valve and means permitting the push-piece to be actuated by the guide means 4 when the pouch is under a controlled atmosphere.

The invention claimed is:

1. A method for placing a watch case (5) fitted with a movement under a protective atmosphere, comprising the following steps:

installation of the watch case, which is not completely closed, in a housing (2) of a support (1) comprising means (3) for holding the watch as well as means (4, 13) for guiding an actuator (7, 12) acting on a part of the case;

introduction of the support (1) into a flexible pouch (10), the flexible pouch (10) being an open pouch (10);

installation of the support (1) in the open pouch (10) in a device for imposing a protective atmosphere;

reduction of the pressure within the device for imposing a protective atmosphere;

closure of the pouch (10) containing the support (1) to realize a sealed pouch (10);

extraction of the support (1) from the sealed pouch (10) of the device for imposing a protective atmosphere;

closure of the watch case by acting on the actuator (7, 12) via an outside of the pouch (10) in order that the actuator (7, 12) displaces a part of the watch according to the guide means (4, 13) in order to close the watch; and opening of the pouch (10) and separation of the actuator (7, 12) from the part of the case on which the actuator (7, 12) acts.

2. The method as claimed in claim 1, wherein the watch case is installed in the support (1) in an open position, the case bottom not being fixedly connected to the case and wherein the actuator is formed by a bottom push-piece (12) sliding in a cylindrical guide member located at the bottom of the support (1), and wherein the case is closed by acting on the bottom push-piece (12) via the outside of the pouch (10) so as to case-up the case bottom in the watch case.

3. The method as claimed in claim 2, wherein the reduction of the pressure within the casing of the device for imposing a protective atmosphere is effected progressively over a period of time until a pressure of the order of 1 to 3 mbar is achieved.

4. The method as claimed in claim 3, further comprising the following supplementary steps during placement of the watch case under a controlled atmosphere:

introduction of a neutral gas under a pressure of the order of about one hundred mbar, into the casing of the device for imposing a controlled atmosphere and maintenance under these conditions over a period of time.

5. The method as claimed in claim 3, wherein the pouch (10) surrounding the support (1) is made of transparent synthetic material.

6. The method as claimed in claim 2, further comprising the following supplementary steps during placement of the watch case under a controlled atmosphere:

introduction of a neutral gas under a pressure of the order of about one hundred mbar, into the casing of the device for imposing a controlled atmosphere and maintenance under these conditions over a period of time.

7. The method as claimed in claim 2, wherein the pouch (10) surrounding the support (1) is made of transparent synthetic material.

8. The method as claimed in claim 1, wherein the watch case is installed closed in the support (1) except for a winding stem (8), wherein the actuator is formed of a stem push-piece (7) sliding in a guide member (3), and wherein the watch case is closed by acting via the outside of the pouch (10) on the stem push-piece (7) so as to introduce the winding stem (8) into the watch case.

9. The method as claimed in claim 8, wherein the reduction of the pressure within the casing of the device for imposing a protective atmosphere is effected progressively over a period of time until a pressure of the order of 1 to 3 mbar is achieved.

10. The method as claimed in claim 9, further comprising the following supplementary steps during placement of the watch case under a controlled atmosphere:

introduction of a neutral gas under a pressure of the order of about one hundred mbar, into the casing of the device for imposing a controlled atmosphere and maintenance under these conditions over a period of time.

11. The method as claimed in claim 9, wherein the pouch (10) surrounding the support (1) is made of transparent synthetic material.

12. The method as claimed in claim 8, further comprising the following supplementary steps during placement of the watch case under a controlled atmosphere:

introduction of a neutral gas under a pressure of the order of about one hundred mbar, into the casing of the device for imposing a controlled atmosphere and maintenance under these conditions over a period of time.

13. The method as claimed in claim 8, wherein the pouch (10) surrounding the support (1) is made of transparent synthetic material.

14. The method as claimed in claim 1, wherein the reduction of the pressure within the casing of the device for imposing a protective atmosphere is effected progressively over a period of time until a pressure of the order of 1 to 3 mbar is achieved.

15. The method as claimed in claim 14, further comprising the following supplementary steps during placement of the watch case under a controlled atmosphere:

introduction of a neutral gas, e.g. helium, under a pressure of the order of about one hundred mbar, into the casing of the device for imposing a controlled atmosphere and maintenance under these conditions over a period of time.

16. The method as claimed in claim 14, wherein the pouch (10) surrounding the support (1) is made of transparent synthetic material.

17. The method as claimed in claim 1, further comprising the following supplementary steps during placement of the watch case under a controlled atmosphere:

introduction of a neutral gas under a pressure of the order of about one hundred mbar, into the casing of the device for imposing a controlled atmosphere and maintenance under these conditions over a period of time.

18. The method as claimed in claim 17, wherein the pouch (10) surrounding the support (1) is made of transparent synthetic material.

19. The method as claimed in claim 1, wherein the pouch (10) surrounding the support (1) is made of transparent synthetic material.

* * * * *